US008235090B2

(12) United States Patent
Frank et al.

(10) Patent No.: US 8,235,090 B2
(45) **Date of Patent: *Aug. 7, 2012**

(54) PISTON MOLD ASSEMBLY AND METHOD OF CONSTRUCTING A PISTON THEREWITH

(75) Inventors: Timothy D. Frank, Elkhart, IN (US); Christopher T. Shoptaw, Granger, IN (US)

(73) Assignee: Federal-Mogul Powertrain, Inc., Southfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/008,250

(22) Filed: Jan. 18, 2011

(65) Prior Publication Data

US 2011/0108229 A1 May 12, 2011

(51) Int. Cl.
*B22D 33/04* (2006.01)

(52) U.S. Cl. ..... 164/137; 164/340

(58) Field of Classification Search ..... 164/137, 164/340, 132, 346

See application file for complete search history.

(56) References Cited

U.S. PATENT DOCUMENTS

| | | | |
|---|---|---|---|
| 2,286,994 | A | 6/1942 | Nocar |
| 2,287,524 | A | 6/1942 | Jackson |
| 2,676,372 | A | 4/1954 | Venner et al. |
| 2,711,568 | A | 6/1955 | Palmer et al. |
| 2,789,329 | A | 4/1957 | Peterson et al. |
| 2,948,031 | A | 8/1960 | Webb |
| 4,206,799 | A | 6/1980 | McDonald |
| 4,695,421 | A | 9/1987 | Takeda |
| 5,074,352 | A | 12/1991 | Suzuki |
| 5,295,379 | A | 3/1994 | Trbovich et al. |
| 5,295,804 | A | 3/1994 | Dinnan |

FOREIGN PATENT DOCUMENTS

| | | | |
|---|---|---|---|
| JP | 61074817 | A | 4/1986 |
| JP | 2001150097 | | 6/2001 |
| KR | 820001905 | B1 | 10/1982 |

*Primary Examiner* — Kuang Lin

(74) *Attorney, Agent, or Firm* — Robert L. Stearns; Dickinson Wright, PLLC

(57) ABSTRACT

A mold assembly for forming a piston and method of molding a piston therewith includes a pair of mold halves moveable toward and away from one another along a linear path that is substantially perpendicular to a longitudinal central axis of the piston between an engaged position to provide at least a portion of a mold cavity for forming an outer periphery of the piston and a disengaged position to allow extraction of the piston from the mold cavity. The assembly also has a pair of cooling gallery mandrels moveable along a linear path into an engaged position between the pair of mold halves to form an undercut cooling gallery of the piston. The pair of cooling gallery mandrels are movable to a disengaged position to allow extraction of the piston vertically along the axis.

2 Claims, 3 Drawing Sheets

PISTON MOLD ASSEMBLY AND METHOD OF CONSTRUCTING A PISTON THEREWITH

CROSS-REFERENCE TO RELATED APPLICATION

This application claims the benefit of U.S. Provisional Application Ser. No. 60/911,650 filed Apr. 13, 2007 and U.S. application Ser. No. 12/102,379, filed Apr. 14, 2008, which is incorporated herein by reference in its entirety.

BACKGROUND OF THE INVENTION

1. Field of the Invention

This invention relates generally to pistons and methods of construction thereof, and more particularly to piston mold assemblies and pistons molded therewith.

2. Related Art

It is known to construct a piston with an annular cooling gallery having an external undercut located immediately radially inward of a piston ring belt. The undercut provides an overhanging portion of ring belt, which in turn causes problems in casting of the piston. To avoid machining the undercut after casting, the mold cavity must have a projection or panel with a negative shape of the desired undercut. However, in order to extract or remove the molded piston from the mold cavity, the panel must be moved completely out of the undercut and the mold cavity. Because the depending ring belt is formed radially outward from the undercut, the panel cannot be simply moved radially outwardly in a purely horizontal direction. Additionally, pin bosses depending from the ring belt are formed in the molding process. The pin bosses are spaced from one another and flare laterally outwardly with respect to a central axis of the piston. As such, the pin bosses prevent the undercut forming panel from being moved downwardly in a purely vertical direction. Accordingly, to overcome this problem, known mold assemblies include a panel that must be pivoted out of the mold cavity. However, the pivoting motion of the panel restricts the size of the available undercut that can be formed depending on the envelop dimensions of the mold cavity.

SUMMARY OF THE INVENTION

A mold assembly for forming a piston has a pair of mold halves moveable toward and away from one another along a linear path that is substantially perpendicular to a longitudinal central axis of the piston between an engaged position to provide at least a portion of a mold cavity for forming an outer periphery of the piston and a disengaged position to allow extraction of the piston from the mold cavity. The assembly also has a pair of cooling gallery mandrels moveable toward each other along a converging linear path that is oblique to the central axis into an engaged position between the pair of mold halves to form an undercut cooling gallery of the piston. The pair of cooling gallery mandrels are movable away from each other along a diverging linear path relative to the axis to a disengaged position to allow extraction of the piston vertically along the axis.

According to another aspect of the invention a method of forming a piston is provided. The method includes moving a pair of first mandrels along a converging linear path oblique to a central axis of the piston into an engaged position. Also, moving a pair of mold halves toward one another to an engaged position to provide at least a portion of a mold cavity with the first mandrels being received in the mold cavity. Then, introducing a quantity of fluid piston material into the mold cavity and curing the fluid piston material to form a solid piston having an upper crown formed by the mold halves and a cooling gallery formed by the first mandrels, wherein the cooling gallery is undercut in the upper crown. Further, moving the first mandrels away from one another along a diverging linear path oblique to the central axis to a disengaged position substantially removed from the mold cavity. Further yet, moving the mold halves to a disengaged position, and removing the cured piston from the mold cavity.

In accordance with another aspect of the invention, a method of forming a piston includes moving a pair of first mandrels along a linear path into an engaged position. Further, moving a pair of mold halves into an engaged position to provide at least a portion of a mold cavity with the first mandrels being received in the mold cavity while in their engaged position. Then, introducing a quantity of fluid piston material into the mold cavity and curing the fluid piston material to form a solid piston having an upper crown formed by the mold halves and a cooling gallery formed by the first mandrels, wherein the cooling gallery is undercut radially inwardly from a ring belt of the upper crown. Next, moving the first mandrels linearly to a disengaged position substantially removed from the mold cavity and moving the mold halves to a disengaged position. Lastly, removing the cured piston from the mold cavity.

BRIEF DESCRIPTION OF THE DRAWINGS

These and other aspects, features and advantages of the invention will be readily appreciated when considered in connection with the following detailed description of the presently preferred embodiments and best mode, appended claims and accompanying drawings, wherein:

DETAILED DESCRIPTION OF PRESENTLY PREFERRED EMBODIMENTS

Figure 1:
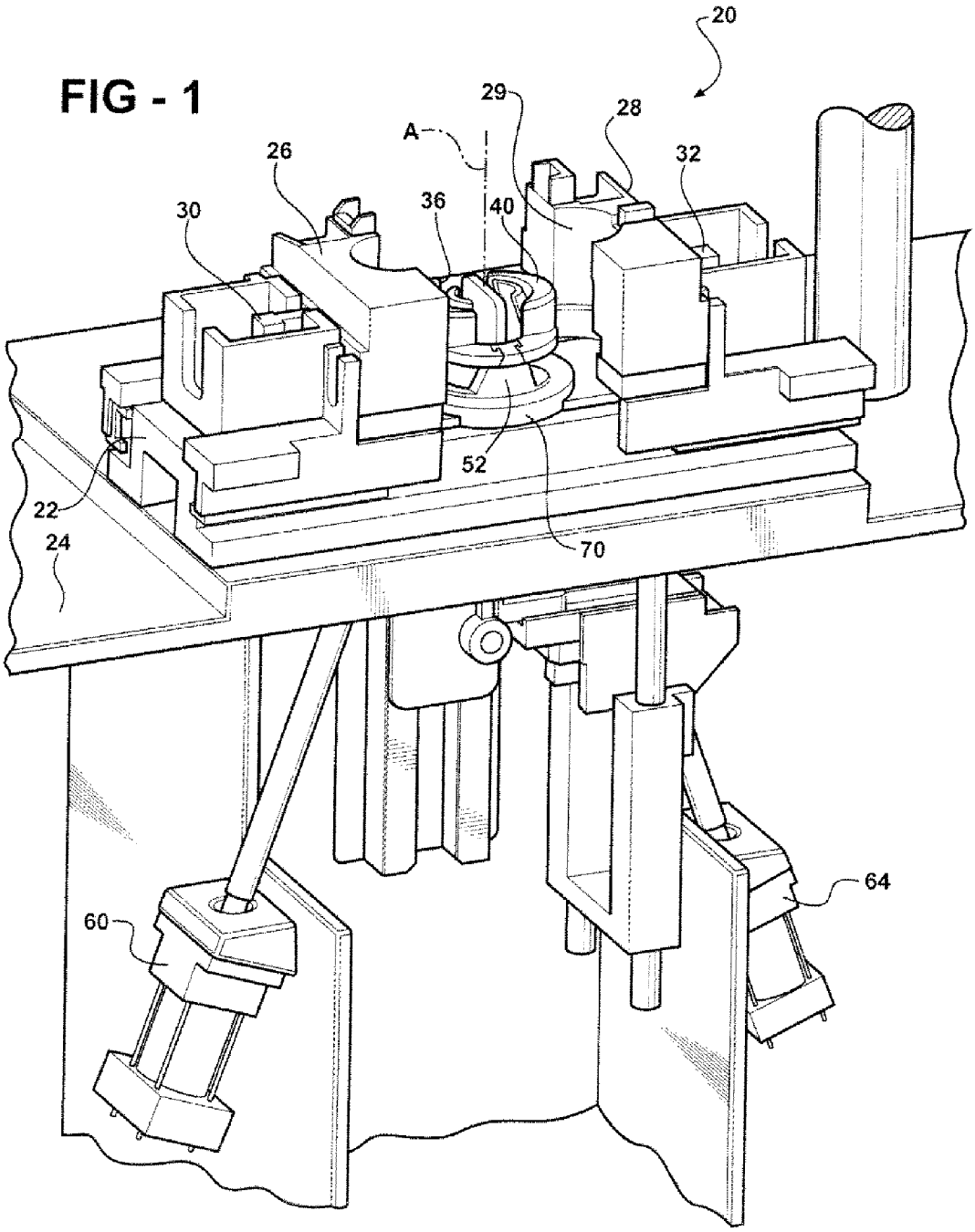
FIG. 1 is a perspective view of a mold assembly in accordance with one presently preferred embodiment of the invention.
Figure 2:
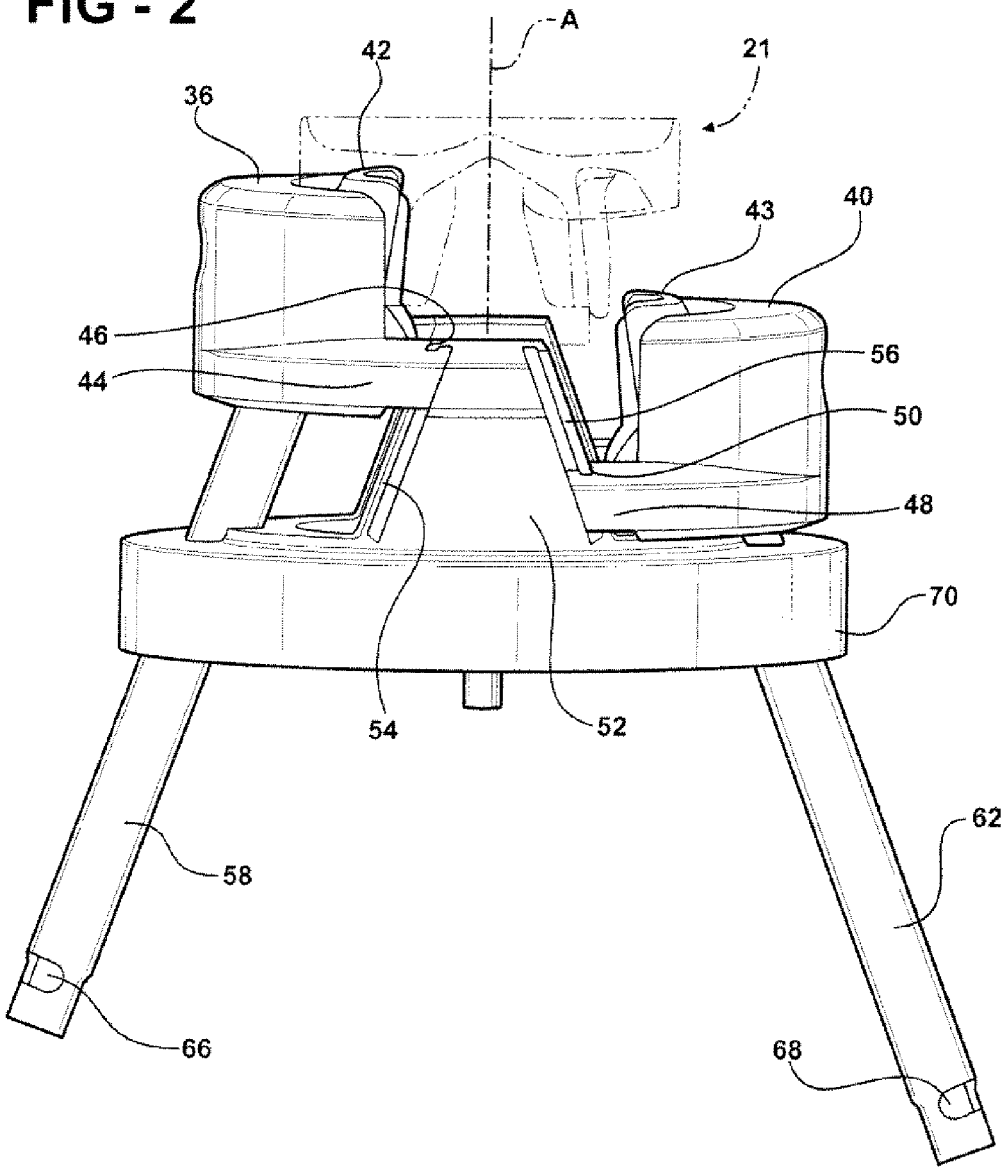
FIG. 2 is a perspective view of a panel and guide of the mold assembly of FIG. 1 shown in isolation.
Figure 3:
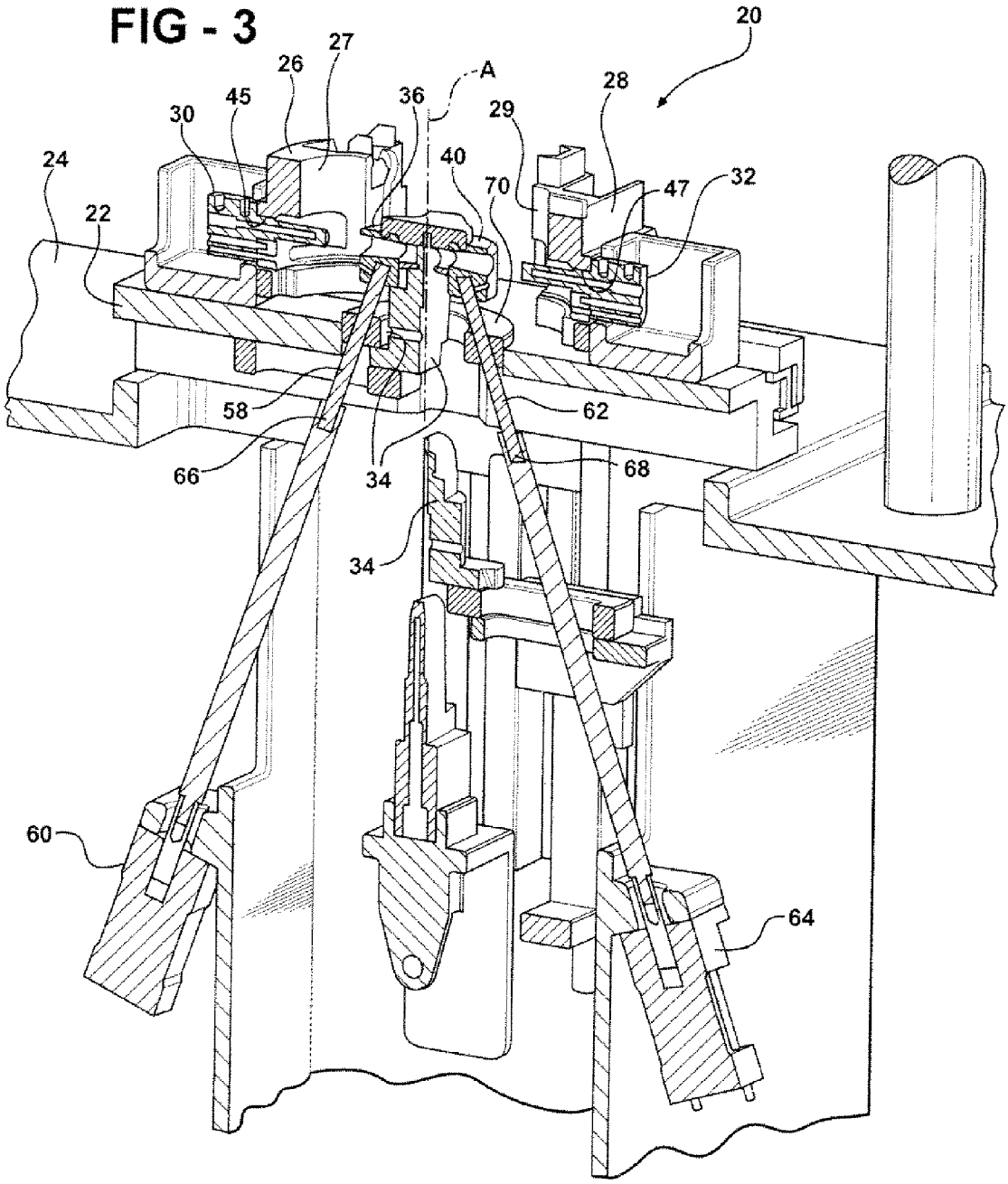
FIG. 3 is a cross-sectional perspective view of the mold assembly.

Referring in more detail to the drawings, wherein like numerals indicate corresponding parts throughout the several views, FIGS. 1-3 illustrate a mold assembly constructed in accordance with one presently preferred embodiment generally at 20. The mold assembly 20 has a slide, referred to hereafter as a platform 22 secured to a base, referred to hereafter as a support surface 24. A first mold half, referred to hereafter as a left mold piece 26 is operably connected to the platform 22 to provide a left portion of a mold cavity. An opposite second mold half, referred to hereafter as a right mold piece 28 is operably connected to the platform 22 to provide a right portion of the mold cavity opposite the left portion. The left and right mold pieces 26, 28 are movable in a linear sliding motion toward and away from one another along the platform 22 between an engaged, closed position and a disengaged, open position. When in the engaged position, the left and right mold cavities cooperate to provide a substantially circumferentially enclosed mold cavity about a longitudinal central axis A. The mold pieces 26, 28 have inner mold surfaces 27, 29 (shown without ring grooves, but are contemplated to be formed in the mold pieces) configured to form an outer peripheral portion of a piston 21, including a piston crown with ring belt extending radially about the central axis A. When in the disengaged, open position, the left and right mold pieces 26, 28 are spaced laterally apart from one another a distance sufficient to allow the finished piston to be removed or extracted vertically from the mold assembly 20.

The mold assembly 20 includes a pair of second mandrels (first mandrels introduced hereafter), including a left pin bore mandrel, referred to hereafter as a left projection 30 that extends generally horizontally from the left mold piece 26 and a right pin bore mandrel, referred to hereafter as a left projection 32 that extends generally horizontally from the right mold piece 28. The left and right projections 30, 32 are movable between an extended, engaged position and a retracted, disengaged position. When in the engaged position, the left and right projections 30, 32 extend into the mold cavity when the left and right mold pieces 26, 28 are engaged to form a left pin bore of a left pin boss and a right pin bore of a right pin boss, respectively. When in the disengaged position, the left and right projections 30, 32 are moved apart from one another sufficiently to be removed from the mold cavity to further facilitate extraction of the piston in a purely vertical direction from the mold assembly 20 along the axis A. The left and right projections 30, 32 can be provided to form any size pin bore and can maintained in coaxial relation to one throughout their extended and retracted movement.

The mold assembly 20 also includes a third mandrel or pin boss mandrel, referred to hereafter as a lower mold projection 34 that is operably connected to the platform 22 and disposed generally centrally between the left and right mold pieces 26, 28 for movement coaxially along the axis A. The lower mold projection 34 is movable relative to the platform 22 between a raised, engaged position and a lowered, disengaged position. When in the engaged position, the lower mold projection 34 extends upwardly into the mold cavity and forms a space occupied by the projection 34 between the left and right pin bosses of the piston 21. When in the disengaged position, the lower mold projection 34 is lowered downwardly and removed from the mold cavity to further yet facilitate extraction of the piston 21 from the mold assembly 20. According to one presently preferred embodiment, the lower mold projection 34 is formed in separate, mirrored left and right sections, wherein the separate sections are movable relative to one another between their engaged and disengaged positions, if desired. The lower mold projection 34 and the left and right mold pieces 26, 28 cooperate to form the pin bosses that depend from the piston crown, wherein the pin bosses can be formed flaring outwardly at an angle with respect the axis A.

The mold assembly 20 forms the piston 21 having an undercut cooling gallery, wherein the undercut is formed directly radially inward of the ring belt, such that at least a portion of the ring belt and the cooling gallery are radially aligned. Accordingly, at least a portion of the depending ring belt forms a obstruction to direct radial access from outside of the cooling gallery. The undercut substantially annular cooling gallery extends about the central axis A of the piston 21. The cooling gallery absorbs heat from a combustion bowl formed on an upper surface of the piston crown. To facilitate molding the undercut of the piston 21, the mold assembly 20 includes a first pair of mandrels or cooling gallery mandrels, including one cooling gallery mandrel, referred to hereafter as a left panel 36, and another cooling gallery mandrel, referred to hereafter as a right panel 40. The left and right panels 36, 40 are configured having a negative forms 42, 43 each providing half of the finished undercut cooling gallery without the need for secondary machining. The left and right panels 36, 40 are movable relative to the platform 22, and relative to the left and right mold pieces 26, 28 between an extended, engaged position and a retracted, disengaged position. When in the engaged position, the left and right panels 36, 40 cooperate with the left and right mold pieces 26, 28 to provide the shape of the piston, including the undercut cooling gallery. When in the disengaged position, the left and right panels 36, 40 are displaced downwardly relative to the respective left and right mold pieces 26, 28 and the piston 21 to permit extraction of the finished piston 21 from the mold assembly 20. The panels 36, 40 are capable of creating a 30 millimeter or greater depth undercut in the vertical direction, and a 12 millimeter or greater undercut in the horizontal direction. The size of the undercut is independent of other casting dimensions.

As a result of the undercuts formed radially inwardly of the ring belt, and the outward flaring pin bosses, the left and right panels 36, 40 cannot be moved away from the piston 21 in either a purely horizontal or a purely vertical direction. The disengaged position of the left panel 36 is therefore located downwardly and radially outwardly (relative to the axis A) of the engaged position. The disengaged position of the right panel 40 is located downwardly and radially outwardly of the engaged position. Accordingly, the left and right panels 36, 40 are moved along a converging linear path toward one another as they move from the disengaged position to the engaged position, and conversely, along a diverging linear path away from one another as they move from the engaged position to the disengaged position. The left and right panels 36, 40 include opposite, mirrored openings 45, 47 to form an appropriately sized bores for slidably receiving the left and right projections 30, 32 therethrough when extended between their engaged and disengaged positions.

To facilitate sliding movement of the left and right panels 36, 40, the left panel 36 has a laterally extending left base rib 44, with a guide member, represented here, by way of example and without limitation, as a left notch 46 formed therein, and the right panel 40 has a laterally extending right base rib 48 with a guide member, represented here, by way of example and without limitation, as a right notch 50 formed therein. A guide fixture, referred to hereafter as guide 52, is disposed centrally between the left and right panels 36, 40. The guide 52 includes opposite guide members, represented here, by way of example and without limitation, as left and right slide rails 54, 56. The left notch 46 slidably receives the left rail 54 and the right notch 50 slidably receives the right rail 56. The notches 46, 50 and respective rails 54, 56 provide smooth sliding movement of the left and right panels 36, 40 between their engaged and disengaged positions.

To further facilitate sliding movement of the left and right panels 36, 40, a left panel rod 58 is connected to the left panel 36 at a first end of the rod. The left panel rod 58 is connected to a left actuator 60 at a second end of the rod. The left actuator 60 moves the left panel 36 between its engaged and disengaged positions. A left release 66 is provided at the second end of the left panel rod 58 for selectively detaching the left panel rod 58 from the left actuator 60. Likewise, a right panel rod 62 is connected to the right panel 40 at a first end. The right panel rod 62 is connected to a right actuator 64 at a second end. The right actuator 64 moves the right panel 40 between its engaged and disengaged positions. A right release 68 is provided at the second end of the right panel rod 62 for selectively detaching the right panel rod 62 from the right actuator 64. The left and right releases 66, 68 permit the panels 36, 40 from being easily detached from the mold assembly 20 for repair, maintenance or replacement.

The actuators 60, 64 can be provided as any suitable type of actuator capable of creating linear movement, such as hydraulic, pneumatic, or mechanical actuators 60, 64, for example. The use of the left and right panel rods 58, 62 enables the left and right panels 36, 40 to be extracted from the mold cavity while the left and right mold pieces 26, 28 are in their engaged position earlier in the mold cycle. As such, the potential for scrap is reduced which could otherwise result from the cast piston shrinking about and onto the panels 36, 40. The actuators 60, 64 operate to position the left and right panels 36, 40 in their location for casting. To provide reliable, repeatable and accurate final positioning of the panels 36, 40 for molding the piston, the left and right ribs 44, 48 are engaged and captured or locked by the left and right mold pieces 26, 28 as the mold pieces 26, 28 are moved from their disengaged position to their engaged position during the mold closure.

A ring 70 is connected to the platform 22 and disposed coaxially beneath the guide 52. The ring 70 supports the guide 52 and includes a pair of through bores for receiving the left and right panel rods 58, 62. The left and right panel rods 58, 62 are guided for smooth, sliding movement through the bores via bushings or bearings. The bushings or bearings significantly reduce the load on the connection between left and right side rails 54, 56 and the left and right notches 46, 50 by eliminating the propensity to twist, and bind. Providing the three points of support via the rails, notches and bushings/bearings promotes stability of the sliding motion of the panels 36, 40 and their ability to function without error in production.

The guide 52 has a base that extends circumferentially along the ring 70. The guide 52 inclined rails 54, 56 are spaced radially about the axis A by about 180 degrees to support an opposite end of the left and right panels 36, 40. The lower mold projection 34 extends upwardly through an opening 71 in the center of the ring 70. The left and right rails 54, 56 extend upwardly from the ring 70 and are inclined at an angle converging toward one another, forming a trapezoidal outline. Moving the left and right panels 36, 40 linearly away from the piston 21 along the appropriate inclination of the rails 54, 56 avoids damaging the ring belt that is located directly radially outwardly from the undercut formed by the panels 36, 40, and also avoids damaging the pin bosses, which flare outwardly from the center of the piston 21 toward the panels 36, 40. The included angle of inclination of the rails 54, 56 provided in the exemplary embodiment is acute with respect to the axis A, providing a sufficient vertical movement component to avoid interfering with the ring belt, and a sufficient horizontal movement component to avoid interfering with the pin bosses.

In accordance with another aspect of the invention, a method of forming the piston 21 with the mold assembly 20 is provided. The method includes molding the piston 21 by moving the panels 36, 40 having the desired undercut configuration linearly along the rails 54, 56 into their engaged position along the converging path that is oblique to the axis A. The moving of the panels 36, 40 brings the panels 36, 40 into position for receipt with the mold cavity. The method further includes moving the left and right mold pieces 26, 28 linearly in a direction substantially perpendicular to the axis A into their engaged position and in proximity with one another to provide at least a portion of a mold cavity having the peripheral shape of a desired piston configuration. The mold pieces 26, 28 are brought into engagement with the panels 36, 40 to ensure their proper positioning within the mold cavity. The engaging process includes capturing the ribs 44, 48 with the mold pieces 26, 28 as the mold pieces 26, 28 are moved from their disengaged position to their engaged position during the mold closure. It should be recognized that the timing of movement of the left and right mold pieces 26, 28 and the left and right panels 36, 40 could be reversed, if desired, wherein the capturing mechanism between the panels 36, 40 and the mold pieces 26, 28 could be modified. Further yet, the method includes moving the left projection 30 through the bore 45 formed in the left panel 36 generally perpendicular to the axis A to provide a left pin bore through a left pin boss of the piston 21 and moving a right projection 32 through the bore 47 formed in the right panel 40 generally coaxially with the left projection 30 to provide a right pin bore through a right pin boss of the piston 21. In addition, the method includes moving the lower mold projection 34 upwardly in coaxial relation to the axis A into proximity with the left and right mold pieces 26, 28 and between the left and right panels 36, 40 to provide a space between the left and right pin bosses. Next, the method includes introducing a predetermined quantity of fluid piston material, such as a molten metal, into the mold cavity. The method then follows by curing the fluid piston material to form the solid piston 21. Upon the molten metal being cured, the method then includes removing the formed piston 21 from the mold cavity.

In order to remove the piston 21 from the mold cavity, the method includes moving the left and right projections 30, 32 from the mold cavity to their disengaged position, and preferably moving the mold pieces 26, 28 at least partially toward their disengaged position laterally along a linear path out of proximity with one another. Further, the removal process includes moving the panels 36, 40 linearly in a downwardly and laterally outwardly direction radially away from the axis A and the solid piston along the diverging paths provided by the rails 54, 56, thereby moving the panels 36, 40 out of the mold cavity and out of engagement with the mold pieces 26, 28. The movement of the panels 36, 40 is initiated by sliding the rods 58, 62 connected to the respective panels 36, 40 through the bores of a support ring 70. It should be recognized that any suitable linear actuators can be used, as described above, to move the various mold components described above. Lastly, the method includes extracting the solid piston 21 from the mold assembly 20.

It is to be understood that the above detailed description is with regard to some presently preferred embodiments, and that other embodiments which accomplish the same function are incorporated herein within the scope of any ultimately allowed patent claims.

What is claimed is:

1. A method of casting a piston comprising:

moving a pair of first mandrels along a converging linear path oblique to a central axis into an engaged position;

moving a pair of mold halves into an engaged position to provide at least a portion of a mold cavity with said first mandrels being received in said mold cavity while in their engaged position;

moving a lower mold projection in a vertical direction along said central axis to an engaged position spaced from and between at least a portion of said pair of first mandrels in their engaged position;

introducing a quantity of fluid piston material into said mold cavity;

curing the fluid piston material to form a solid piston having an upper crown formed by said mold halves and a cooling gallery formed by said first mandrels and a pair of pin bosses formed by said lower mold projection and said mold halves, said cooling gallery being undercut radially inwardly from a ring belt of said upper crown, and said pin bosses flaring outwardly at an angle with respect to said central axis;

moving said first mandrels along a diverging linear path oblique to said central axis to a disengaged position substantially removed from said mold cavity;

moving said mold halves to a disengaged position; and thereafter moving said lower mold projection in a vertical direction along said central axis to a disengaged position substantially removed from said mold cavity; and removing the cured piston from said mold cavity.

2. The method of claim 1 further including moving said mold halves along a linear path substantially perpendicular to said central axis between said engaged and disengaged positions.

* * * * *